United States Patent [19]

Zay

[11] Patent Number: 4,694,845

[45] Date of Patent: Sep. 22, 1987

[54] COIN COUNTER AND WRAPPER AND METHOD OF COUNTING AND WRAPPING COINS

[76] Inventor: John Zay, 23623 Emmons Rd., Columbia Station, Ohio 44028

[21] Appl. No.: 859,703

[22] Filed: May 5, 1986

[51] Int. Cl.[4] ..... G07D 9/06

[52] U.S. Cl. ..... 453/59; 53/254

[58] Field of Search ..... 133/1 R, 1 A, 8 R, 8 A, 133/8 B, 8 D; 53/254; 248/111

[56] References Cited

U.S. PATENT DOCUMENTS

| | | | |
|---|---|---|---|
| 722,546 | 3/1903 | Werle | 211/62 |
| 777,059 | 12/1904 | Petroskey | 211/62 X |
| 1,274,615 | 8/1918 | Sherwood | 133/1 A X |
| 1,457,261 | 5/1923 | Mathewes | 133/1 A X |
| 2,150,473 | 3/1939 | Wagner | 53/254 |
| 2,532,603 | 12/1950 | Carper | 53/254 X |
| 2,996,864 | 8/1961 | Cook | 53/254 |
| 3,206,914 | 9/1965 | Norris | 53/254 |
| 3,685,661 | 8/1972 | Kimmel | 211/64 |
| 3,710,544 | 1/1973 | Lamming | 133/1 R X |
| 3,967,435 | 7/1976 | Bergmaler | 53/254 |
| 4,109,668 | 8/1978 | Malacheski | 133/8 R |
| 4,339,071 | 7/1982 | Hall | 133/1 A X |
| 4,407,313 | 10/1983 | Ventura | 133/8 A |
| 4,407,314 | 10/1983 | Ventura | 133/8 A |

FOREIGN PATENT DOCUMENTS

| | | | |
|---|---|---|---|
| 553110 | 1/1933 | Fed. Rep. of Germany | 53/254 |
| 2543162 | 7/1977 | Fed. Rep. of Germany | 133/8 R |
| 314519 | 3/1934 | Italy | 211/60 |

*Primary Examiner*—Robert J. Spar

*Assistant Examiner*—P. McCoy Smith

*Attorney, Agent, or Firm*—Renner, Otto, Boisselle & Lyon

[57] ABSTRACT

The disclosure relates to a coin counter and wrapper holder for use with conventional paper coin wrappers and to a method of counting and wrapping coins. The device includes a base from which pedestals project upwardly, each pedestal terminating in a circular end face. Each pedestal fits inside and forms a support for the lower end portion of a conventional paper coin wrapper of a specific denomination. Also mounted to the base is an upper wrapper support which has a U-shaped slot proportioned to fit around the outside of each coin wrapper. Each of the pedestals is proportioned so that the distance from its top surface to the top surface of the upper wrapper support is the same as the height of a stack of coins intended for a particular wrapper. The distance between the top of each pedestal and the base is arranged so that each coin wrapper will abut the base at one end and be flush with the top surface of the upper wrapper support at its opposite end. An accurate and speedy coin count is thus assured. The pedestal for dimes has a shoulder which positions the dimes wrapper which is shorter than the others. Although shown with four pedestals, one for quarters, one for dimes, one for nickels, and one for pennies, the device could be made with more or fewer pedestals to accommodate additional denominations and can be manufactured to suit foreign denominations if desired. Further, although shown with the pedestals uniformly spaced about the perimeter of a circular base, the apparatus could be made in other arrangements.

12 Claims, 6 Drawing Figures

COIN COUNTER AND WRAPPER AND METHOD OF COUNTING AND WRAPPING COINS

BACKGROUND OF THE INVENTION

The present invention relates to a device to facilitate counting and wrapping of coins and to a method of counting and wrapping coins.

Many people, for one reason or another, accumulate loose coins and would redeem these coins for paper currency or deposit these coins in a bank if a convenient method and apparatus were provided to accurately count the coins and wrap them in standard coin wrappers. Any method and device directed to this problem must assure that the count or number of coins placed in each wrapper is accurate, and the process of putting coins in wrappers must be simple.

Heretofore, coin banks with graduated cylinders have facilitated coin counting. Other coin counting devices have included cylinders of a predetermined effective length so that when a standard number of coins of a given denomination fill the cylinder completely, the cylinder contains a predetermined number of coins. However, once such a stack of the desired length is achieved, either the entire stack must be removed from the cylinder and placed in a wrapper or, in some instances, a wrapper can be slid between the stack of coins and the inside wall of the counting cylinder. This operation can be difficult if the coins are not in perfect alignment.

Other coin wrapping devices have made it possible to accurately center a stack of coins in a wrapper, but only after the coins forming a stack have been counted.

Examples of various types of coin counters and wrapping facilitating devices are found in U.S. Pat. Nos. 1,710,353; 2,150,473; 4,091,599; 4,153,197; and 4,339,071.

SUMMARY OF THE INVENTION

The present invention overcomes the difficulties encountered in using the prior art devices. The present invention makes it possible to put coins in a conventional coin wrapper and at the same time to count them accurately. There is no need to transfer a pre-counted stack of coins into a wrapper. An accurate count is assured even as the coins are placed individually into the wrapper.

To this end the coin wrapper and counter of the present invention includes a base with four pedestals extending upwardly from the base. Each pedestal is roughly cylindrical and has an outside diameter proportioned to fit within a standardized coin wrapper for a particular denomination of coin. In one preferred embodiment the four pedestals are proportioned to support wrappers for quarters, dimes, nickels, and pennies. Each of the pedestals fits inside of and forms a support for the lower end portion of a standard coin wrapper.

The upper end portion of each coin wrapper is at least partialy surrounded by an upper wrapper support. The upper wrapper support serves two functions. First, it prevents lateral displacement of the coin wrapper and the stack of coins forming in it. Second, the top surface of the upper wrapper support serves as a reference surface to indicate when the number of coins in each stack has reached the standard predetermined count. In order to achieve this, the distance between the top surface of each pedestal and the topmost surface of the upper wrapper support corresponds to the standardized length of a stack of coins supported on that pedestal, e.g., fifty pennies, forty nickels, fifty dimes, or forty quarters.

The upper wrapper support is positioned relative to the base so that when the lower end of each wrapper abuts the base (except the wrapper for dimes), the upper end of the wrapper will be flush with or only slightly below the top surface of the upper wrapper support. This is possible because the standard wrappers for pennies, nickels and quarters are all of the same length. The wrapper for dimes is somewhat shorter, and accordingly the pedestal for the dimes has a shoulder which limits downward movement of the wrapper onto the support. The shoulder is positioned so that the top edge of the dime wrapper is flush with the top surface of the upper wrapper support when a dimes wrapper is placed over the dimes pedestal.

In use four coin wrappers are placed over the respective pedestals. Then coins may be counted and collected merely by dropping them into the appropriate wrapper. The count in any one wrapper is completed up to the desired count when the top surface of the topmost coin is flush with the top of the upper stack support. Thereupon, the wrapper may be slid upwards along the length of the stack of coins until it is approximately centered on the stack, and then the stack and wrapper are removed as a unit from the device and the ends of the wrapper are folded over in a conventional manner.

The invention, then, comprises the features hereinafter fully described and particularly pointed out in the claims, the following description and the annexed drawings setting forth in detail an illustrative embodiment of the invention, this being indicative, however, of but one of the various ways in which the principles of the invention may be embodied.

DESCRIPTION OF PREFERRED EMBODIMENT

Figures 1, 2, 3, 4, 5, 6:
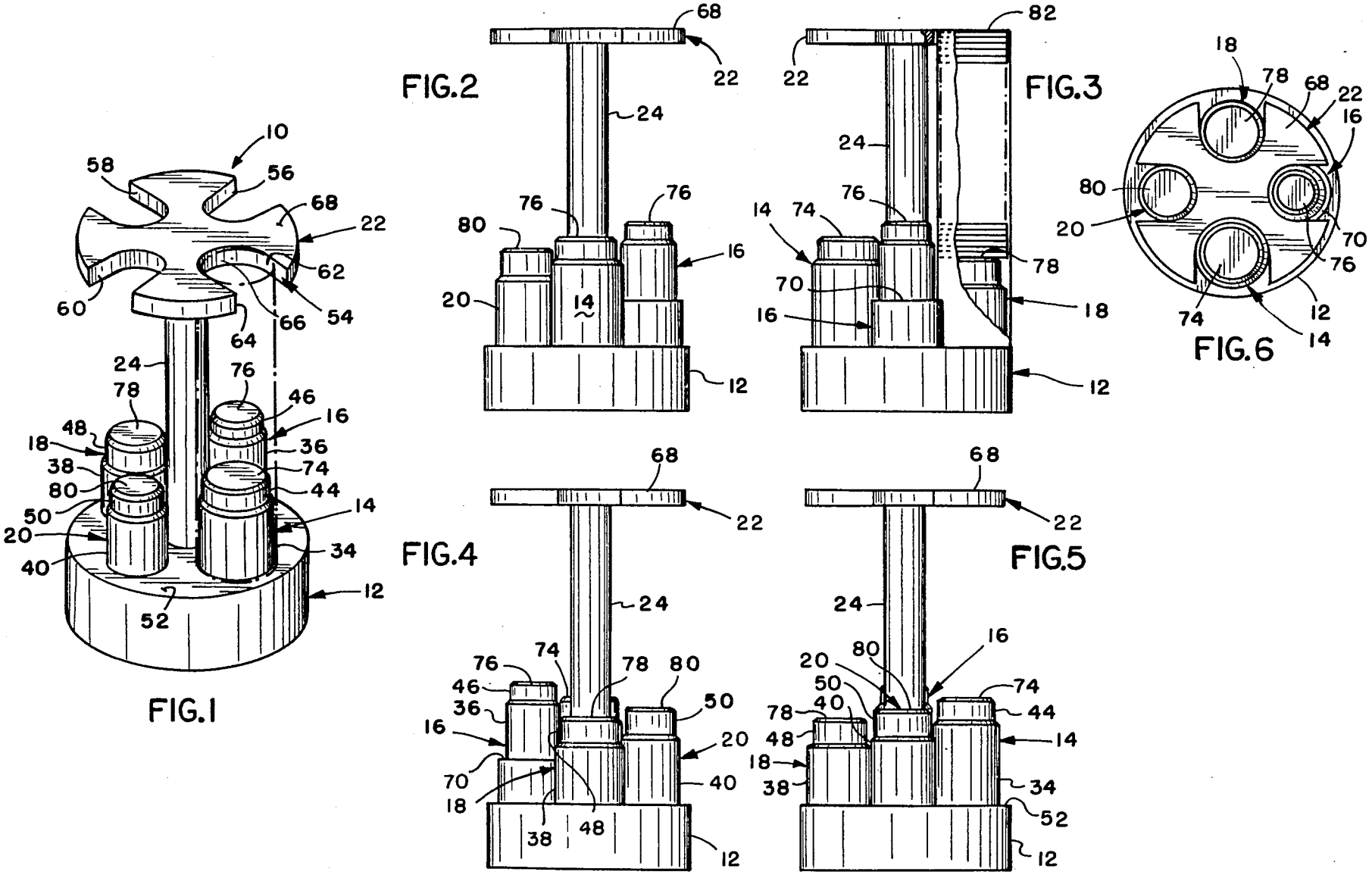
FIG. 1 is a perspective illustration of a coin counter and wrapper constructed in accordance with the present invention.
FIGS. 2–5 are elevation views of the coin counter and wrapper of FIG. 1 viewed from the front, back and opposite sides.
FIG. 6 is a top view of the coin counter and wrapper of FIG. 1.

The coin counting and wrapping device 10 shown in the Figures includes a base 12 and four pedestals 14, 16, 18, and 20 which support and position coin wrappers for quarters, dimes, nickels and pennies, respectively. An upper wrapper support 22 is mounted by means of a post 24 to the base 12, and this upper wrapper support serves both to position the upper end portion of the coin wrappers mounted on the pedestals 14–20 and also as a reference surface to accurately mark when the correct number of coins has been placed in each wrapper.

Each of the pedestals 14–20 is generally cylindrical. The lower portion 34, 36, 38, and 40 of each of the pedestals 14, 16, 18, and 20, respectively, is proportioned to fit inside the corresponding coin wrapper. Thus the outside diameter of the base portion 34 of the pedestal 14 is approximately the same as the diameter of a quarter. Likewise, the base portion 36 is about the same as the diameter of a dime, the base portion 38 is about the diameter of a nickel, and the base portion 40 is about the diameter of a penny. Although shown as cylindrical, the pedestals 14, 16, 18, and 20 could have polygonal or other cross-sections instead. It is only important that the pedestals hold their respective wrappers open so that coins will stack squarely in the wrappers, and, as will be clear from what follows, in proper vertical alignment with the upper wrapper support 22.

The upper end portions 44, 46, 48, and 50 of the pedestals 14, 16, 18, and 20, respectively, each have a reduced diameter connected with the respective lower portions 34, 36, 38, and 40 by beveled surfaces. The reduced diameter upper end portions and the beveled connecting surfaces facilitate placing a coin wrapper on the pedestal and removal of full wrappers as discussed below. Coin wrappers are conventionally supplied folded flat, and the reduced diameter upper end portion of each pedestal allows the wrapper to be placed on the pedestal without having to form it to a perfect circular cross-section before it will fit. In use each of the pedestals supports a conventional coin wrapper (one shown in phantom in FIG. 1) in a generally vertical orientation with its bottom end abutting the top 52 of the base 12.

The upper wrapper support 22 (FIGS. 1 and 6) is a bracket formed from a circular disk of material in which four U-shaped slots 54, 56, 58, and 60 are formed. Each U-shaped slot, e.g., slot 54, has generally vertical parallel and opposite side walls 62 and 64 joined by a semicircular end wall 66. The diameter of the end wall 66 and hence the distance between the opposite straight walls 62 and 64 is proportioned so that the slot, e.g., 54, embraces and supports the outside of a coin wrapper, e.g., a wrapper for quarters.

The post 24 is proportioned so that the distance between the top 52 of the base 12 and the top 68 of the upper wrapper support 22 is the same as the standard length for coin wrappers for quarters, nickels and pennies. The standard wrappers for coins of these denominations are all the same length. When wrappers for these three denominations are placed over the pedestals 14, 18, and 20 with their bottom edges abutting the top 52 of the base 12, their top edges are flush with the top 68 of the upper wrapper support.

The conventional wrapper for dimes is shorter than the other three wrappers. The pedestal 16 (FIGS. 1–4) for dimes includes a shoulder 70 which acts as a stop to limit movement of the dimes wrapper. The shoulder 70 positions the top edge of the dimes wrapper flush with the top 68 of the upper wrapper support. Thus for quarters, nickels, and pennies the top 52 of the base 12 provides an end stop means which accurately positions the respective coin wrappers with respect to the upper wrapper support. For dimes the same function is performed by the shoulder 70.

The vertical dimensions of the pedestals 14, 16, 18, and 20 are proportioned to cooperate with the upper wrapper support 22 to assure an accurate coin count in each of the four wrappers. Each of the pedestals 14, 16, 18, and 20 terminates in a circular end face 74, 76, 78, and 80, respectively. The distance between each end face and the top surface 68 of the upper wrapper support 22 is selected to equal to the length of a standard stack of coins. Of course the length of a standard stack of each of quarters, dimes, nickels, and pennies differs from the others, and so the end faces 74, 76, 78, and 80 are each a different distance from the top surface 68 of the upper wrapper support 22.

To use the device 10 it is only necessary to place four coin wrappers over the respective pedestals 14, 16, 18, and 20. FIG. 3 shows a wrapper for nickels partially cut away and a full stack of nickels. Each coin wrapper is slid over the pedestal until it will go no further. For quarters, nickels and pennies this means that the lower end of the wrapper abuts the top surface 52 of the base 12. For a dime wrapper, the lower end abuts the shoulder 70 on the pedestal 16. The wrappers when properly positioned on the respective pedestals have their top edges flush with the upper, reference surface 68 of the upper wrapper support. Thereafter coins may be dropped into the respective wrappers as they are accumulated. When the top surface of the topmost coin, e.g., surface 82 in FIG. 3, in any stack is flush with the top or reference surface 68 of the upper wrapper support 22, the user knows that the wrapper has the predetermined number of coins in it.

For quarters, forty quarters makes a full wrapper. The distance between the top surface 74 of the pedestal 14 and the uppermost surface 68 of the upper wrapper support 22 is equal to the height of a stack of forty quarters. Similarly, the distance between end face 76 of pedestal 16 and the upper surface 68 of the upper wrapper support 22 is equal to the height of a stack of fifty dimes. The distance between the upper surface 78 of the pedestal 18 and the top surface 68 of the upper wrapper support 22 is equal to the height of a stack of 40 nickels. The distance between circular end face 80 and the top surface 68 of the upper wrapper support 22 is equal to the height of a stack of fifty pennies. Thus the top surface 68 serves as a reference surface to assure an accurate coin count in each wrapper.

Once the proper number of coins has been placed in a wrapper, the wrapper may be slid upwards along the stack of coins until it is approximately centered on the stack. Then the wrapper may be pinched at the end by gripping it in the area of the reduced diameter portion of the pedestal and lifted off the pedestal together with the stack of coins in it. Next the ends of the wrapper are folded over in a conventional manner.

The reduced diameter upper end portions 44, 46, 48, and 50 of the pedestals 14, 16, 18 and 20, respectively facilitate removal of a full wrapper and centering of a complete stack within the wrapper. The user simply grasps the full wrapper with thumb and index finger around the base portion, e.g., base portion 34, and slides the wrapper upward while squeezing lightly. The coin stack remains stationary until the finger and thumb reach the reduced diameter portion, e.g., 44. At that point the squeezing by finger and thumb constricts the wrapper to less than the diameter of the coin stack, and so the stack of coins begins to move with the wrapper. The axial position of the juncture of the enlarged base portions 34, 36, 38 and 40 and their respective reduced diameter upper end portions 44, 46, 48 and 50 is selected so that the stack of coins is sufficiently centered in the wrapper to permit the ends to be folded over.

The coin counting and wrapping device 10 may be made of metal or plastic or a combination thereof. It is only important that the material be dimensionally stable so that the geometry of the device can be relied upon for an accurate coin count. If plastic or other material more flexible than metal is used, conventional webs and reinforcing members may be used to stabilize the device. Specifically, regardless of materials used, the dimensions must be stable to within less than half of the thickness of a dime, which is the thinnest coin. It is only essential that when the correct number of coins are present in any stack, it is immediately evident that upon adding one more coin the supernumerary coin is above the top surface 68 of the upper wrapper support 22. Thus, "flush" has a practical or pragmatic meaning as used herein. In this regard, it is known that the standard lengths for coin wrappers vary slightly due to imprecise manufacturing conditions. The distance between the top surface 52 of the base 12 and the top surface 68 of the upper wrapper support 22 is selected to be at the outer limits of the standard variation of wrapper lengths. Thus it is an abnormal wrapper which will extend above the top surface 68 of the upper wrapper support 12. Most wrappers will be even with the top surface 68 or within a few thousandths of an inch of being even with the top surface 68. Wrappers which fall on the short end of the normal variation will be less than one coin's thickness below the top surface 68 of the upper wrapper support 22.

The present invention overcomes the difficulties encountered in using the prior art devices and makes it possible to put coins in a conventional coin wrapper easily and to count them accurately. There is no need to transfer a pre-counted stack of coins into a wrapper. An accurate count is assured even as the coins are placed individually into the wrapper.

I claim:

1. A coin counter and wrapper holder for use with a coin wrapper intended to contain a stack consisting of a predetermined number of coins, said coin counter and wrapper holder comprising a base, first wrapper support means connected with said base for positioning a first end portion of a coin wrapper, end stop means connected with one of said base and first wrapper support means for abutting a first end of the coin wrapper to limit axial movement of the coin wrapper in one direction, second wrapper support means connected with said base for positioning a second end portion of the coin wrapper, said second wrapper support means having a surface flush with a second end of the coin wrapper opposite the first end thereof and surface means defining a side opening in said second wrapper support means proportioned for receiving and embracing the coin wrapper, said second wrapper support means including a post connected with said base and a bracket including a plate which includes said surface, said bracket being mounted to said post, and coin stack positioning means for supporting a stack of coins consisting of the predetermining number of coins with one end of the stack flush with said surface of said second support means wherein said first wrapper support means comprises an upstanding member proportioned to fit inside the coin wrapper and said coin stack positioning means comprises an end face of said upstanding member.

2. The device of claim 1 wherein said surface means defining a side opening of said second wrapper support means includes a U-shaped side opening including a pair of parallel side walls and semicircular end wall, the diameter of said semicircular end wall being porprotioned to embrace a coin wrapper.

3. The device of claim 1 including a plurality of pairs of first and second wrapper support means, each pair supporting a wrapper for a different coin denomination.

4. The device of claim 3 wherein said base has a generally circular top surface and said plurality of first wrapper support means are mounted to said top surface of said base uniformly spaced about a perimeter portion thereof.

5. The device of claim 1 wherein said post extends upward from the center of said base and including four of said first wrapper support means, each for a different denomination of coin, said four wrapper support means being uniformly spaced about the perimeter of a circle centered about said post.

6. The device of claim 1 wherein said first wrapper support means includes a base portion, said base portion being adjacent said end stop means and proportioned to fit inside the coin wrapper and a distal portion remote from said end stop means having a reduced cross sectional area from that of said base portion.

7. A coin counter and wrapper holder for use with a coin wrapper intended to contain a stack consisting of a predetermined number of coins, said coin counter and wrapper holder comprising a base, first wrapper support means connected with said base for positioning a first end portion of a coin wrapper, end stop means connected with one of said base and first wrapper support means for abutting a first end of the coin wrapper to limit axial movement of the coin wrapper in one direction, said first wrapper support means including a base portion adjacent said end stop means and proportioned to fit inside the coin wrapper and a distal portion remote from said end stop means having a reduced cross-sectional area from that of said base portion, said base portion and said distal portion of said first wrapper support means being cylindrical and connected by a conical portion, second wrapper support means connected with said base for positioning a second end portion of the coin wrapper, said second wrapper support means having a surface flush with a second end of the coin wrapper opposite the first end thereof and surface means defining a side opening in said second wrapper support means for receiving and embracing the coin wrapper, and coin stack positioning means for supporting a stack of coins consisting of a predetermined number of coins with one end of the stack flush with said surface of said second support means.

8. The device of claim 7 wherein said distal portion includes an end face normal to the axis of said distal portion.

9. A method of forming coins into a stack of predetermined length, said method comprising the steps of opening a coin wrapper and placing a lower end portion of the coin wrapper over a pedestal to support and position the lower end of the wrapper, supporting the upper end portion of the wrapper with a support member which has a reference surface flush with the top of the wrapper and which is a predetermined fixed distance from a coin supporting surface of the pedestal, stacking coins in the wrapper on the coin supporting surface of the pedestal until the exposed face of the last coin placed in the wrapper is flush with the reference surface of the support member, removing the stack of predetermined length by sliding the wrapper along the stack to approximately center the wrapper on the stack, gripping the lower end portion of the wrapper to pinch the lowermost coins in the stack within the wrapper while the upper end portion of the wrapper is supported by the support member, and thereafter removing the lower end portion of the wrapper from the pedestal.

10. The method of claim 9 wherein said step of putting the lower end portion of a coin wrapper over a pedestal includes the step of abutting an end of the coin wrapper adjacent the lower end portion against a first surface which is fixed with respect to the pedestal thereby to limit the extent of movement of the wrapper onto the pedestal.

11. A coin counter and wrapper holder for use with a coin wrapper intended to contain a stack consisting of a predetermined number of coins, said coin counter and wrapper holder comprising a base, first wrapper support means connected with said base for positioning a first end portion of a coin wrapper, end stop means connected with one of said base and first wrapper support means for abutting a first end of the coin wrapper to limit axial movement of the coin wrapper in one direction, second wrapper support means connected with said base for positioning a second end portion of the coin wrapper, said second wrapper support means having a surface flush with a second end of the coin wrapper opposite the first end thereof, said first wrapper support means having a base portion adjacent said end stop means and proportioned to fit within the wrapper and permit gripping by a user without constricting the wrapper into pinching engagement with the coin stack and a distal portion proportioned to permit gripping by a user to pinch the wrapper into engagement with the coin stack to enable removal of the wrapper and coin stack from the pedestal, and coin stack positioning means for supporting a stack of coins consisting of the predetermined number of coins with one end of the stack flush with said surface of said second support means.

12. The device of claim 11 wherein said base portion of said first wrapper support means includes a cylindrical base portion and said distal portion comprises a cylindrical distal portion, said cylindrical distal portion having a reduced cross sectional area from that of said cylindrical base portion and connected to said cylindrical base portion by a conical portion.

* * * * *